United States Patent [19]

Berge et al.

[11] 4,144,797

[45] Mar. 20, 1979

[54] DEVICE FOR A TURRET APPLIED TO A TANK

[75] Inventors: Sven E. Berge, Stockholm; K. Sten R. Hultgren, Karlskoga, both of Sweden

[73] Assignee: AB Bofors, Bofors, Sweden

[21] Appl. No.: 857,643

[22] Filed: Dec. 5, 1977

Related U.S. Application Data

[63] Continuation of Ser. No. 722,257, Sep. 10, 1976, abandoned.

[30] Foreign Application Priority Data

Sep. 12, 1975 [SE] Sweden ..... 7510202

[51] Int. Cl.[2] ..... F41F 9/04; F41G 5/24

[52] U.S. Cl. ..... 89/41 M; 89/36 K; 89/36 L; 89/46

[58] Field of Search ..... 89/36 H, 36 K, 36 L, 89/40 B, 41 E, 45, 46, 47, 41 M, 41 H

[56] References Cited

U.S. PATENT DOCUMENTS

| | | | |
|---|---|---|---|
| 2,458,956 | 1/1949 | Motley | 89/36 K |
| 3,145,620 | 8/1964 | Even | 89/36 H |
| 3,566,742 | 3/1971 | Bemiss | 89/40 B |
| 3,954,041 | 5/1974 | Mechulam et al. | 89/36 K |

FOREIGN PATENT DOCUMENTS

| | | | |
|---|---|---|---|
| 1947811 | 4/1971 | Fed. Rep. of Germany | 89/40 B |
| 2317711 | 10/1974 | Fed. Rep. of Germany | 89/36 K |
| 592862 | 7/1977 | Switzerland | 89/41 H |

*Primary Examiner*—Stephen C. Bentley

*Attorney, Agent, or Firm*—Pollock, Vande Sande & Priddy

[57] ABSTRACT

An improved low-profile turret for a large-calibre tank-mounted firearm includes a support for operating personnel and a box-shaped structure which permits the turret to blend into the upper surface of the tank. An improved loading pendulum is also disclosed.

12 Claims, 5 Drawing Figures

DEVICE FOR A TURRET APPLIED TO A TANK

This is a continuation, of application Ser. No. 722,257, filed Sept. 10, 1976, now abandoned.

BACKGROUND OF THE INVENTION

The present invention relates to a turret rotatably mounted in a tank chassis and arranged to support a large-calibre firearm.

The primary purpose of the invention is to provide a tank construction in which a high position is provided for a large-calibre firearm, yet the tank hull in other respects has a low profile, which makes it difficult to hit by enemy fire. Another purpose of the invention is to ensure that the disposition of the space for the crew and equipment can be made in a simple and uncomplicated way with optimal utilization of the interior spaces in the tank.

SUMMARY OF THE INVENTION

The problems posed are solved in that the tank is given small external dimensions, particularly vertically, so that a so-called miniturret is formed. Inside the tank, under the turret, a crew position is rotatably arranged in the tank chassis, so that the traversing movements of the crew position are synchronized with the traversing movements of the turret. In a further development of the concept of the invention, the turret is provided on its upper portion with a carrier device for the elevation support of the firearm. Also, the turret is arranged to withstand the great mass and force influences obtained from the firearm.

BRIEF DESCRIPTION OF THE DRAWING

Embodiments proposed at present of a device which has the characteristics significant for the invention will be described in the following, with reference to the accompanying drawings, in which.

DETAILED DESCRIPTION OF THE PREFERRED EMBODIMENT

Figure 1A:
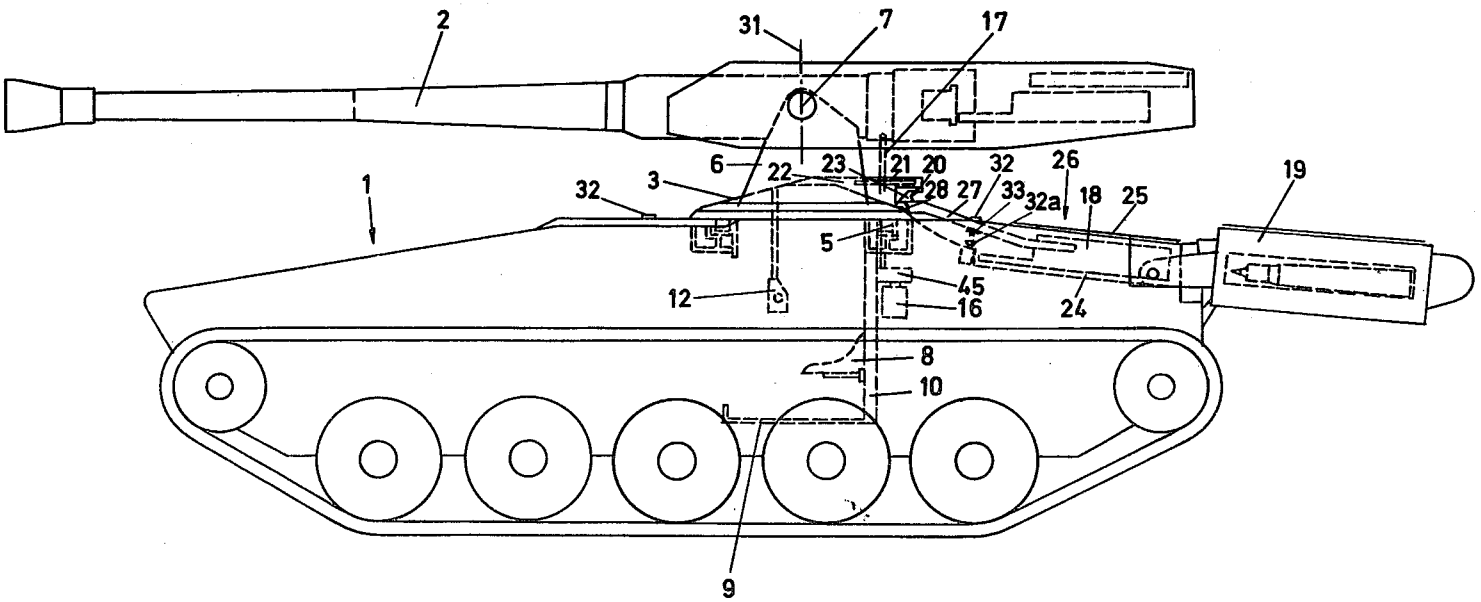
FIG. 1*a* shows a vertical view of a tank utilizing the invention.
Figure 1B:
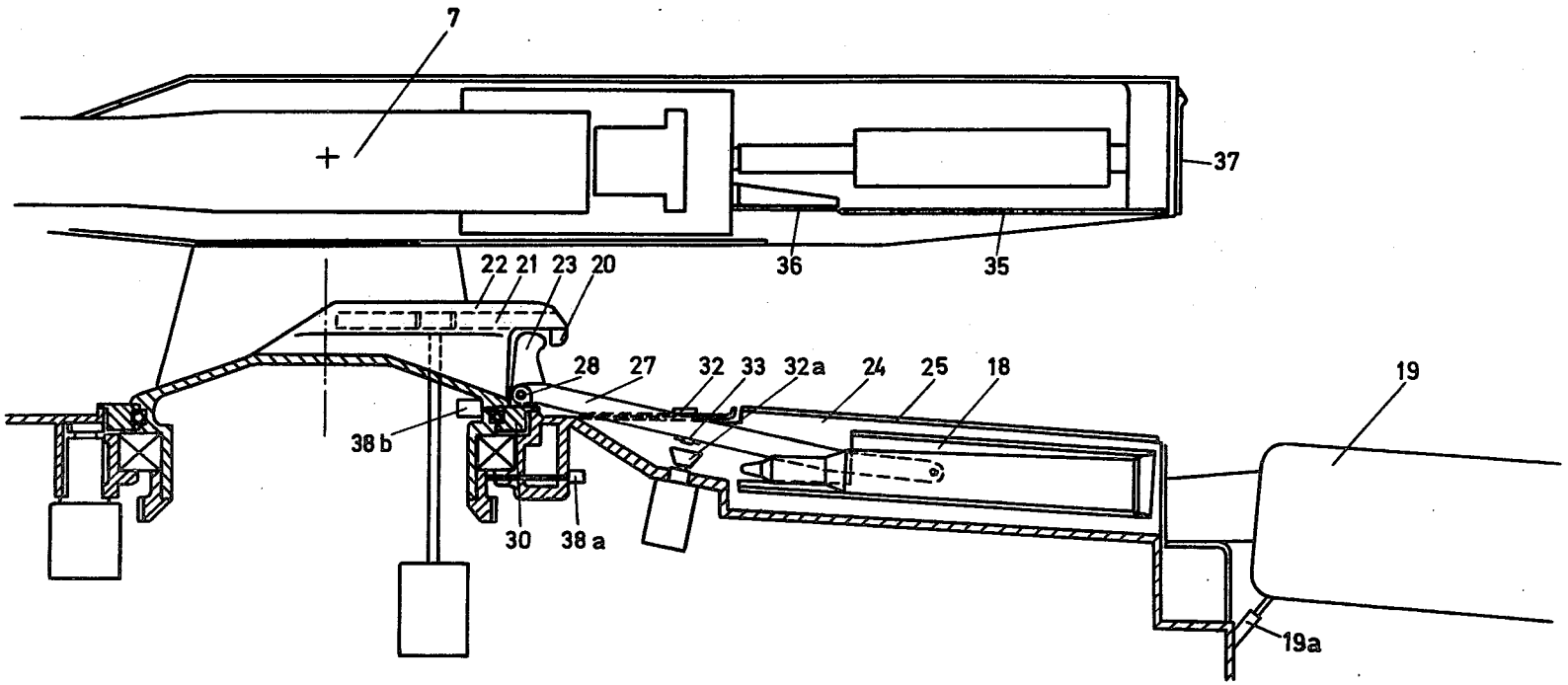
FIG. 1*b* shows a partially sectional, vertical view of a first embodiment of portions of the tank according to FIG. 1.
Figure 2:
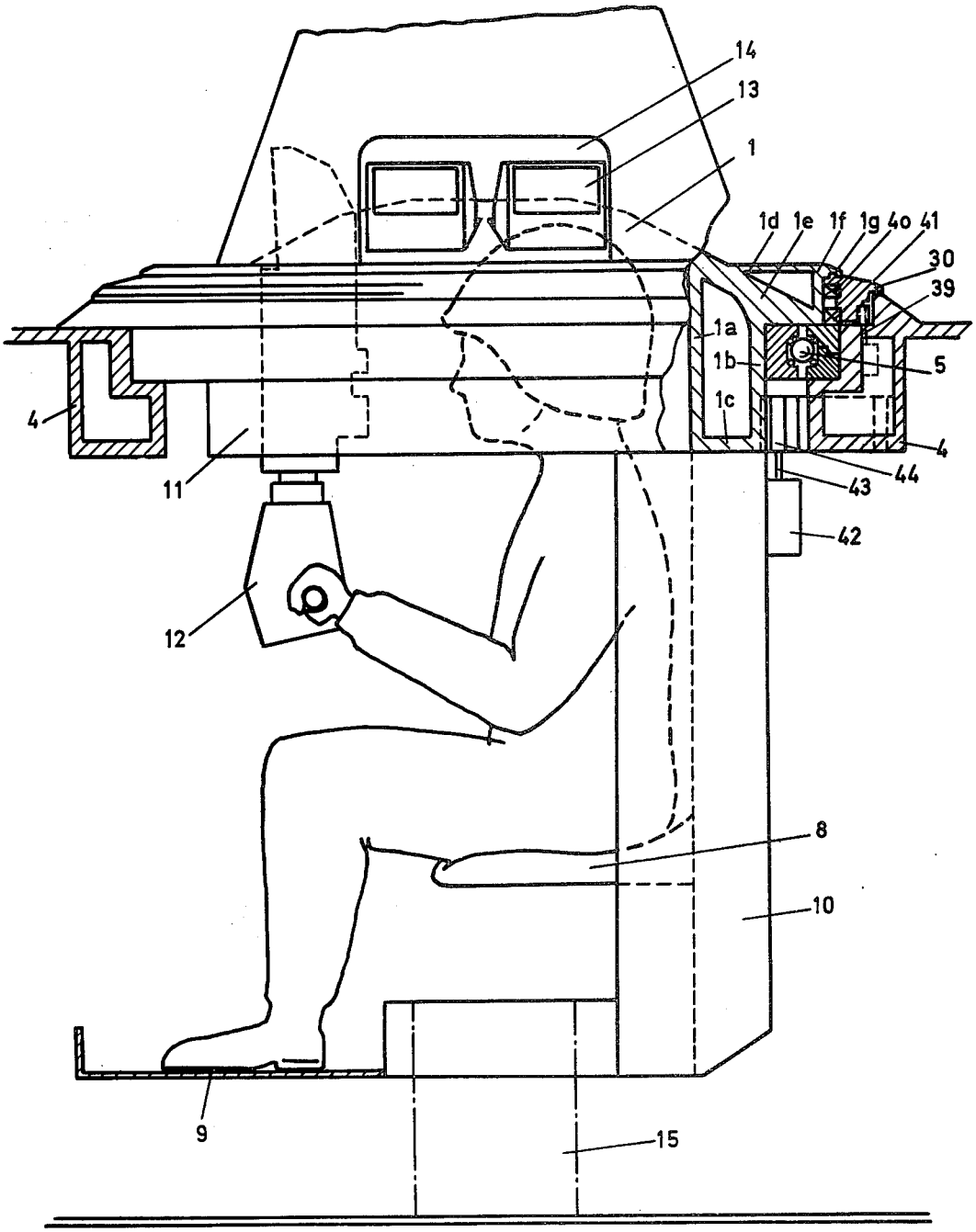
FIG. 2 shows a partially sectional, vertical view of a second embodiment of portions of the tank according to FIG. 1.

In FIGS. 1*a* and 1*b* the hull of a tank is designated 1, and a large-calibre firearm carried by the tank has been designated 2. The tank is provided with a miniturret with small external dimensions particularly vertically. The turret 3 has upper parts with a limited extent above the other parts of the top of the tank, so that the turret essentially adapts itself to the top of the tank. The turret also has parts extending down into the tank chassis, via which the turret is rotatably supported in the tank. Also the turret parts extending downward have a limited extent, so that if a person enters the turret from the inside, with the top of his head close to the ceiling of the turret, the turret will extend essentially on a level with the neck or shoulders of the person. The turret is supported in relation to a annular frame 4 in the tank chassis via a ball bearing 5, as shown in FIG. 2. On its upper part, the turret has a carrier with two side parts 6 in which the elevating trunnions 7 of the firearm are supported.

Under the turret, a crew position is located in the interior of the tank. The crew position has the form of a unit comprising a seat 8 for the crewman and a foot plate 9 situated below the seat. The unit also comprises a fastening member 10 to which the seat and foot plate are fastened and by means of which the seat and foot plate are connected to the turret 3. The fastening member is fixed to the turret at at its downwardly extending parts, preferably to a downwardly directed end edge by means of welding, fastening with bolts and the like. A sight 11 and an aiming device 12 are also connected to the turret to follow its traversing movements. At its upper parts, the turret is made with side viewing apertures 13 arranged at openings in the side parts 6 of the carrier.

FIG. 2 also shows a slip-ring gear 15, located in the crew space in which, however, the seat is not supported. Further, the reference designations 16 and 17 indicate the motor and the rod for the elevating function of the firearm. Said motor and rod with the relevant gear mechanism are located behind the fastening member 10 and follow the traversing movements of the firearm.

The tank is provided with a loading pendulum 18 arranged outside (on top of) the tank which can be actuated between a round-receiving position at a magazine 19 and a round-ramming position within the recoil housing at the rear parts of the firearm. To swing this pendulum between these positions, the turret is made with a rotating mechanism comprising a catch 20 fastened at one end of a straight gear rack 21 which can be actuated by means of a driving shaft on a driving motor located inside the tank. The gear rack is supported in a special recess in the tank, which also has a projection 22; which is elongate and rectangular, and is intended to protect the mechanism from foreign objects. The loading pendulum is arranged not only so that it can be turned up, but can also be swung in a lateral plane so that it can assume various traverse positions independent of the tank chassis and the firearm. A block 23, which can coact with the catch 20 in a lateral position of the loading pendulum which coincides with the lateral position of the firearm is provided on the pendulum.

In the round-receiving position, which also constitutes the rest position of the pendulum when this is not being utilized, the pendulum is arranged in a shaft 24 made in the tank chassis. The shaft has hatch covers 25 which can be opened and closed. The loading pendulum is made with a part 26 for supporting the rounds, and with an arm 27 fastened in the part supporting the rounds which has one of its ends rotatably supported on a supporting shaft 28 which extends at right angles to the plane in FIGS. 1*a* and 1*b*. At its other end arm 27 has a fork-shaped section, the prongs of which extend on either side of the part 26 and are rotatably fastened at the middle of part 26. The connection to part 26 is made with springs arranged so that when the pendulum swings up, it will fix the position of the part 26 so that it will be essentially parallel to the longitudinal axis of the firearm. The part 26 consists of an armour tube which is made with a longitudinal and through slot at its upper end to provide for coaction with a rammer at the firearm. The armour tube is open at its ends, and on the front side it is provided with an extended bottom section. The loading pendulum can be turned up from the shaft position shown in FIGS. 1*a* and 1*b* round-receiving position) by means of a hydraulic cylinder 29 which can coact with the arm 27. It is possible for the loading pendulum to swing in the traversing plane by means of a ring 30 which is rotatable in relation to both the turret 3 and the tank chassis around the traversing axis 31 of the firearm. The loading pendulum is supported on said ring with a trunnion support and the block 23 is rigidly fastened in the arm 27. The loading pendulum is raised with the lifting cylinder 29 from the shaft position to a position where it can coact with a fixed, circular slide track 32. A roller 33 or the like is provided on the arm 27 for contact with track 32. In order to provide for lowering to the shaft position, during which arm 27 must be able to cross the slide track 32, the slide track is made with a lowerable part 32*a*, located where the arm 27 extends to the shaft position. The actuation of the lifting cylinder 29 of the arm 27 will thus take place via the lowerable part 32*a* of the slide track and the roller 33. The loading pendulum will work in a space between the top of the tank and the bottom of the firearm.

The magazine is of the external type, which can be turned up by means of a hydraulic cylinder 19*a* in order to prevent damage in case the tank should run into a ditch or the like. In the horizontal direction, the magazine is rigidly fastened in relation to the tank chassis. The magazine is moreover fastened in such a way that its front edge is located somewhat to the rear of the rear end of the firearm, so that the loading pendulum will be adjustable with one of its ends to the magazine. The magazine has one or two feed-out positions. In the case where there is one feed-out position, the shaft position of the pendulum is distinct, while in the case of there being two feed-out positions on the magazine, the pendulum can be set at an angle in the shaft for coaction with the feed-out position in question. The magazine is made with a known rammer which feeds a round point-first from the magazine to the loading pendulum.

The recoil jacket of the firearm is provided with hatch covers 35, which can be turned up, on its under side. Said hatch covers coact with hatch covers 36 connected to the breech ring of the firearm, the covers 35 and 36 then being located on different levels, so that when the firearm recoils in the recoil jacket they can slide over each other. Said covers can be turned up by the loading pendulum as it moves to the round-ramming position. At its rear end, the recoil jacket is provided with a hatch cover 37 for empty cartridge cases, which cover 37 can be turned up from inside by means of the cartridge cases and is closed by its own weight. At the ejection of the empty cartridge cases the covers 35 and 36 form a trough for the empty cartridge cases. Said hatch covers 35–37 form an efficient seal against foreign objects. At the recoil jacket the firearm is moveover provided with a known two-stage rammer which operates smoothly. Ramming in two stages is necessary as the firearm must permit a certain longitudinal displacement for the part of the loading pendulum which carries the round, due to the fact that the elevation centres of the firearm and the loading pendulum are different.

The turret is also made with mechanical catches 38*a* and 38*b* which are intended to function when the loading pendulum, after having fetched a round, has sought the angle of traverse of the firearm. In the present case, the catches have the form of studs in the tank chassis (38*a*) and the turret (38*b*) which can coact with holes in the ring 30. Said catches can be released when the loading pendulum, after it has transferred the round to the firearm, returns to fetch a new round from the magazine. Said catches are connected to electromagnets or hydraulic valves (not shown), by means of which the catches can be released.

Figure 3:
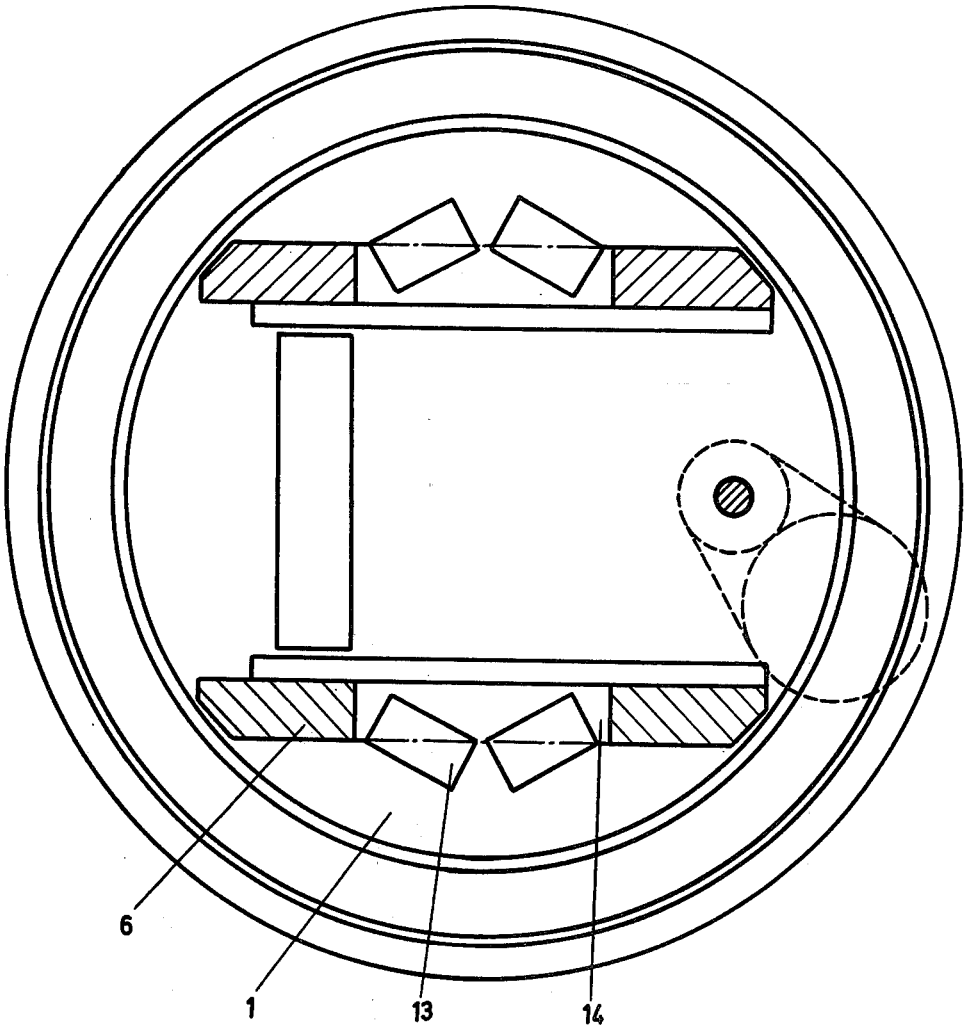
FIG. 3 shows a partially sectional, horizontal view of certain parts comprised in FIG. 2.
Figure 4:
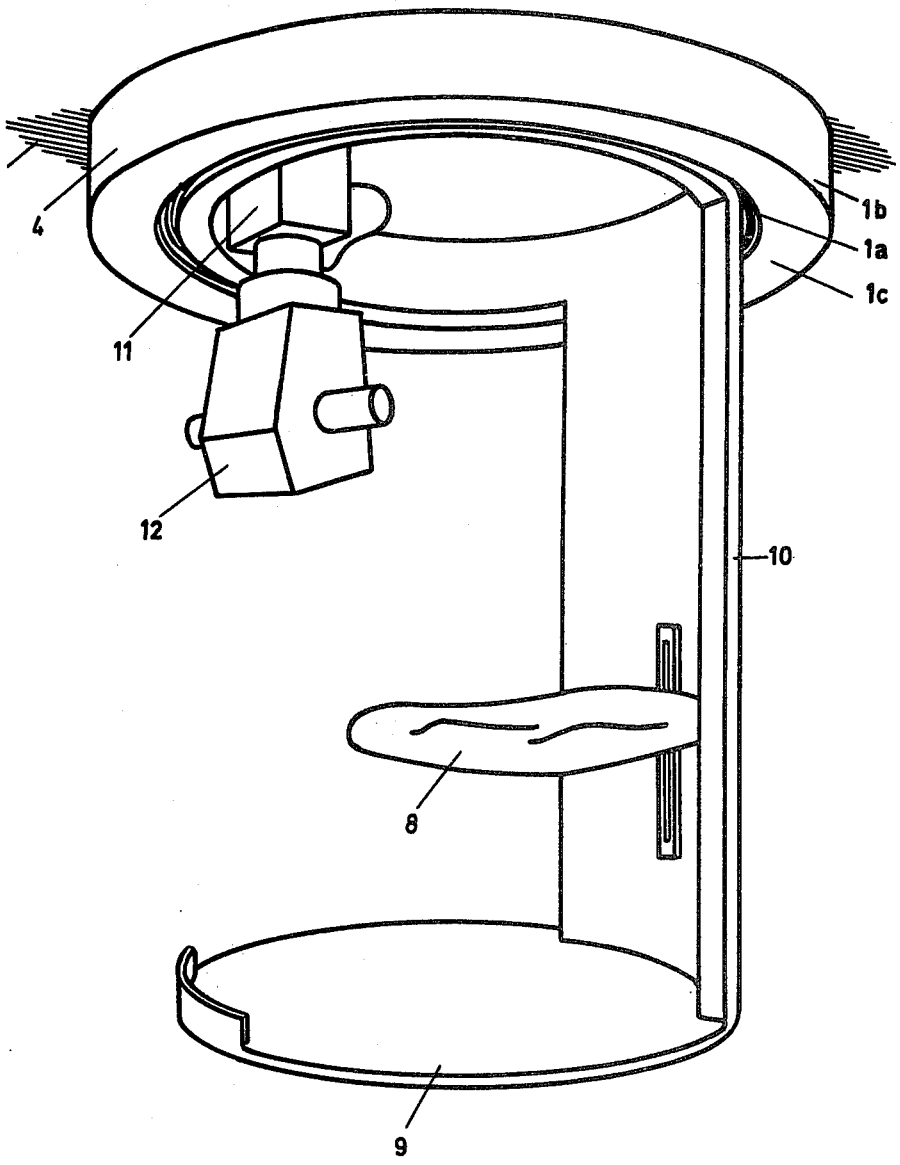
FIG. 4 shows a wide-angle perspective view of the parts of the tank to which the invention relates.

FIGS. 2 and 3 are intended to show parts to which the invention relates in more detail. The frame 4 has a box-shaped cross-section. The ring 30 is provided with an external gear arc via which the ring can be actuated by means of a motor, the shaft of which is designated 39.

The shaft 39, with its gear wheel, is arranged at openings in the frame 4. The turret 1 is made with a roof of heavy armour plate, and in order to achieve a rigid design, the parts extending downwards are made box-shaped with inner and outer walls 1*a* and 1*b* and with a bottom part 1*c* defining an annular frame. At the upper parts the turret is provided with a flange with a triangular cross-section with a horizontal part 1*d*, an oblique part 1*e* and a vertical part 1*f*. The flange extends with an overlapping part 1*g* over the ring 30 which is supported on the outside of the vertical part 1*f* by means of ball bearings 40 and 41. At its parts which extend downwards, the turret is provided with an outer gear arc via which the turret is rotatable with a driving motor 42 with driving shaft and gear wheel, 43 and 44, respectively.

The member 10 consists of a beam which in its cross-section is box and arc shaped. At its lower end, the member is fastened in the seat and foot plate, and at its upper end to the part 1*c* in the turret. The member extends in relation to the part 1*c* $\frac{1}{4}$–$\frac{1}{3}$ of the length of this. The motor 16 and the shaft 17 for the elevating movements of the firearm are fastened in the member via a distribution gear 45 (FIG. 1).

Briefly, the equipment described in the foregoing functions in the following way. The gun is assumed to be tracking a target, and the firearm is to be loaded with a round from the magazine. It is also assumed that in the magazine the round is in the feed-out position. The rammer of the magazine moves the round out point first into the loading pendulum within the parts 26. When the round has been inserted in the pendulum, it is turned up out of the shaft by means of the lifting cylinder 29 so that the pendulum can swing up into the traversing plane, supported on the slide track 32 via its roller 33 on the arm 27. The swinging in the traversing plane then continues until the loading pendulum has a position in traverse which coincides with the traverse position of the firearm, and the catches 33 are then activated. The loading pendulum is then turned up to the ramming position by means of the catch 23. When the two-stage rammer has moved the round out of the loading pendulum at the firearm, the loading pendulum can be returned in the reverse order to the magazine position to receive a new round, and so forth. In conjunction with the ramming, in accordance with the above, the catches 38 are released. The guidance of the loading pendulum is then handled so that, regardless of the traversing position of the firearm, it will always take the shortest way from the magazine to the firearm and from the firearm to the magazine. This guidance can be carried out by means of microswitches, stops, and the like not shown in detail.

The driving motors for the turret, loading pendulum, rammers and so forth can consist of hydraulic or electric motors, and in the electric case the driving can take place partly or entirely by means of the batteries of the tank, so that the driving will be independent of whether or not the tank is running.

Through the construction shown, it is thus possible to obtain an appropriate suspension of the firearm and possibilities of traversing the firearm, at the same time as the profile of the tank under the firearm can be kept low, and the space inside the tank can be used in an optimal way. The power consumption at the traversing of the firearm will also be reasonable.

The invention is not limited to the embodiment shown above as an example, but can be subject to modifications within the scope of the following claims.

We claim:

1. An improved turret structure for an armored vehicle comprising:

a low profile turret mounted for traversing movement in said vehicle, said turret having an upper portion sized to extend only slightly above the top of said vehicle;

a fire-arm carrier mounted on said upper portion of said turret and provided with side portions for supporting a firearm, the vertical height of said side portions substantially exceeding the height of said upper portion;

first box-shaped frame means mounted in said vehicle for supporting said turret for traversing movement in said vehicle;

a crew support station suspended from said turret through said frame means and within said vehicle, for traversing movement with said turret;

ring means rotatably mounted on said turret for traversing movement relative to both said turret and said vehicle; and a loading pendulum pivotably supported on said ring means so that said pendulum may be rotated toward and away from a firearm mounted on said carrier and may traverse with said ring means.

2. Structure according to claim 1, wherein the vertical height of said turret is such that it extends into said vehicle to approximately the level of the neck and shoulders of a person occupying said crew support station.

3. Structure according to claim 1, wherein said crew support station comprises a seat, a foot plate and a fastening member suspending said seat and foot plate from the underside of said turret within said vehicle.

4. Structure according to claim 1, wherein said crew support station comprises a downwardly extending beam of arc-shaped cross-section attached to the underside of said turret for traversing movement therewith and a seat and a foot plate attached to said beam so that said beam is behind a person occupying said crew station.

5. Structure according to claim 1, further comprising means for raising and lowering said pendulum and means located between said side portions for protecting said raising and lowering means from foreign objects.

6. Structure according to claim 3, wherein said fastening member extends along one-fourth to one-third of the periphery of said turret where said turret extends through said first frame means.

7. Structure according to claim 1, wherein said turret further comprises second box-shaped frame means extending downwardly through said first box-shaped frame means, said crew support station being suspended from said second box-shaped frame means.

8. Structure according to claim 1, wherein said turret comprises a peripheral flange which extends at least partially over said ring means.

9. An improved turret structure for an armored vehicle, comprising:

a lower profile turret mounted for traversing movement in an outer frame of said vehicle, said turret having an upper portion sized to extend only slightly above the top of said vehicle and a lower annular frame portion of a box-shaped cross-section extending downwardly from said upper portion into said vehicle;

a fire-arm carrier mounted on said upper portion of said turret and provided with side portions for supporting a fire-arm, the vertical height of said side portions substantially exceeding the height of said upper portion;

annular frame means of box-shaped cross-section attached to said outer frame of said vehicle and surrounding said turret for supporting said turret for traversing movement in said vehicle, with said frame means including a portion extending parallel to and spaced from said lower frame portion to position a turret drive assembly therebetween; and a crew support station suspended from said lower, box-shaped annular frame portion through said box-shaped annular frame means and within said vehicle, for traversing movement with said turret.

10. Structure according to claim 9, wherein the vertical height of said turret is such that it extends into said vehicle to approximately the level of the neck and shoulders of a person occupying said crew support station.

11. Structure according to claim 9, wherein said crew support station comprises a seat, a foot plate and a fastening member suspending said seat and foot plate from said lower, box-shaped annular frame portion, within said vehicle.

12. Structure according to claim 9, wherein said crew support station comprises a downwardly extending beam of arc-shaped cross-section attached to said lower, box-shaped annular frame portion for traversing movement therewith and a seat and a foot plate attached to said beam so that said beam is behind a person occupying said crew station.

* * * * *